United States Patent [19]

Dahlberg

[11] Patent Number: 4,839,034

[45] Date of Patent: Jun. 13, 1989

[54] BENEFICIATOR FOR RECOVERY OF METAL FRACTIONS FROM PARTICULATE GANGUE

[76] Inventor: Carl H. Dahlberg, P.O. Box 753, Bonners Ferry, Id. 83805

[21] Appl. No.: 148,371

[22] Filed: Jan. 25, 1988

[51] Int. Cl.[4] ..... B03B 7/00; B03B 5/62

[52] U.S. Cl. ..... 209/44; 209/13; 209/158; 209/454; 209/488; 209/500

[58] Field of Search ..... 209/445, 446, 454–456, 209/485, 497, 498, 484, 500, 477, 13, 44, 155, 156, 158, 273, 258, 488, 466, 486; 239/575, 570

[56] References Cited

U.S. PATENT DOCUMENTS

| | | | |
|---|---|---|---|
| 11,712 | 9/1854 | Seymour | 209/455 |
| 168,416 | 10/1875 | Reily | 209/454 |
| 899,710 | 9/1908 | Boardman | 209/454 |
| 1,354,550 | 10/1920 | Glockmeier | 209/456 |
| 2,101,295 | 12/1937 | Rusk | 209/466 |
| 2,410,637 | 11/1946 | Darby | 209/454 |
| 2,803,347 | 8/1957 | Whitlock Jr. | 210/190 |
| 3,506,119 | 4/1970 | Rumpf et al. | 209/424 X |
| 3,596,765 | 8/1971 | Beudin et al. | 209/486 X |
| 4,022,685 | 5/1977 | Tisseau | 209/454 X |
| 4,119,276 | 10/1978 | Nelson | 239/590.3 |
| 4,289,241 | 9/1981 | Litrap | 209/44 |
| 4,451,359 | 5/1984 | Osterberg | 209/454 X |
| 4,472,269 | 9/1984 | Swick | 209/44 |
| 4,526,683 | 7/1985 | Walker | 209/423 |

FOREIGN PATENT DOCUMENTS

| | | | |
|---|---|---|---|
| 3418492 | 11/1985 | Fed. Rep. of Germany | 209/158 |
| 11764 | of 1906 | United Kingdom | 209/500 |

*Primary Examiner*—Johny D. Cherry
*Assistant Examiner*—Donald T. Hajec
*Attorney, Agent, or Firm*—Keith S. Bergman

[57] ABSTRACT

Apparatus is provided to separate heavier metal particles from lighter particles gangue in a fluidic medium by gravity and fluid flow. A vertical container provides a lower fluid input chamber that communicates through a medial structure providing a plate defining a plurality of valve ports, a screen, and a plate defining a plurality of holes to an upper chamber carrying particulate material to be beneficiated. Pressurized water flows upwardly through the medial structure to separate more dense metal bearing particles in the medial structure and gangue exits from a central orifice defined in the medial portion of the separating structure. The apparatus uses small amounts of water which may be recycled. The beneficiator is unusually efficient in recovering particulate gold from alluvial sands.

8 Claims, 2 Drawing Sheets

BENEFICIATOR FOR RECOVERY OF METAL FRACTIONS FROM PARTICULATE GANGUE

BACKGROUND OF INVENTION

1. FIELD OF INVENTION

My invention generally relates to beneficiation of particulate ores in a fluidic medium and more particularly to apparatus that uses both fluid flow and gravity, aided by a particular multi-port valving system, to accomplish its purpose.

2. DESCRIPTION OF PRIOR ART

The difference in density between heavier ore material and lighter gangue material has long been used as a basis of separating a mixture of the two materials to recover the metallifeours ore fraction. This is especially true in particulate mixtures of the heavier metals, such as in the case of deposits of alluvial gold, platinum group metals, and the like in sands. Commonly, such beneficiation processes have been accomplished in a fluidic medium such as water, with the aid of gravity, by moving the particulate material in the fluidic media so that it might be acted upon by gravity while in suspension to cause the particulate materials to tend to separate with the more dense material nearest the gravity source.

This type of device has been used especially to separate or beneficiate alluvial deposits of gold and black sands from parent gangue material. Devices for accomplishing this separation have generally involved moving the particulate material relative to a fluid bed, commonly water. Such devices have accomplished this relative motion of fluid and particles in a substantially horizontally oriented course, as in the case of an ordinary sluice box, or in a substantially vertically oriented fashion, as in the case of jigs or fluidic bed separators. Many and various devices of each type have heretofore become known. My invention provides a separator of this general type that embodies the better features of both the sluice-type and a fluidic bed type separators, while yet minimizing the poorer features of each process.

My invention provides an initially vertically oriented fluid flow that changes its course to a substantially horizontal flow prior to exhaustion. This is accomplished by a fluid container with a lower fluid input chamber divided from an upper processing chamber by medial structure including a valving plate having a plurality of valved orifices to allow fluid flow from the lower chamber to the upper chamber over a substantial area. An exhaust orifice is provided in the medial portion of the medial structure so that fluid will move vertically upwardly through the valving structure and then subsequently horizontally to the exhaust system. Prior art devices have generally provided either vertical or substantially horizontal motion of fluid and suspended particulate material being beneficiated, but generally have not provided any appreciable amount of both types of fluid flow in the same device.

My invention further carries a plate of some areal extent to support ore to be beneficiated at a spaced distance above the medial structure dividing the lower chamber from the upper chamber, so that the ore will be contacted by water in the upper chamber and moved downwardly over the periphery of its support plate to enter the treatment area in the medial portion of the device by the water. This causes the ore to enter the treatment area about the periphery of that area so that the ore during treatment will be moved inwardly to the exhaust area. During this course of transit, however, the particulate ore will also be acted upon by the vertically upwardly directed flow of water passing from the lower water chamber to the upper treatment chamber. Prior art devices have generally provided either the horizontal or vertical motion of ore material, but have not in general combined such motion, as does the instant device.

Entrapment means for heavier, more dense particles, including a plate of substantial areal extent defining a plurality of holes and a screen element therebeneath, are carried immediately above the valving plate between the water chamber and the treatment chamber. Water entering the treatment chamber passes vertically upwardly from the valving plate through the entire medial structure so that as particulate material moves thereover, its heavier particles move vertically downwardly into and through the orifices in the screen and hole defining plate to create an action similar to that of the traditional sluice. At the same time, the particles are acted upon by the water moving vertically through the entrapment structure to create somewhat of a fluidic bed-type action that tends to act upon particulate matter in the entrapment structure to further refine its separation by moving lighter particles upwardly and heavier particles downwardly. This latter fluidic bed-type action is particularly useful in recovering smaller particles of gold, such as that commonly referred to as flour gold and having a major dimension in the few micron range and a generally flat, plate-like shape. Such particles tend to be difficult to segregate in any beneficiator and are almost impossible to segregate in a sluice-type device, but my invention is quite adaptable to segregating such particles because of its combined type of action, its particular valving system and the functions resulting therefrom. By reason of this action, flour gold may not only be entrapped in the screen and hole structure but also in the valving structure itself or even in the fluid entry chamber therebelow.

My invention also provides secondary features distinguishing it from the prior art. It uses a relatively small amount of water in proportion to the amount of ore being processed and that water may be recycled, if desired, to allow the device to be used in areas where water is not readily available and must be conserved. The operation of my apparatus is also substantially automatic so that it may be readily and rapidly learned by a person who is substantially unsophisticated in the ore beneficiating art. In massive hydraulic mining operations where large volumes of material varying substantially in size must be dealt with, my invention is particularly useful as a secondary beneficiator to concentrate more dense ore materials from the output of traditional sluice apparatus that has already performed a primary beneficiation function.

My invention also allows quite a wide variation of parameters relating to the ore beneficiation to adapt if for efficient use with particular types of ore. The fluid used in the device may be different than water to vary the density of the fluid bed. The amount of fluid flow may be readily regulated by fluid input volume or pressure, by change in valving orifice size and ball valve weights, and by change of entry orifice size and array. The entrapment structure may be varied by changing the size and array of orifices therein to accomodate particular materials. The input of particulate ore into the device may be varied by changing the size or shape of the ore supporting plate and its vertical position relative to the entrapment structure, all of which will also effect the entrapment process itself. Though a cylindrical configuration of the device is illustrated and preferred, this configuration may also be changed to accommodate particular situations.

My invention differs from the prior art, not in any one of these features or structures, per se, but rather in the synergistic combination of all of them to provide the functions necessarily flowing therefrom, as hereinafter set forth and claimed.

SUMMARY OF INVENTION

My invention generally comprises a vertically oriented cylindrical container divided by a medially positioned valving plate into a lower fluid entry chamber and an upper processing chamber. Plate-like entrapment means having orifices for vertically orientated fluid passage are positioned immediately above the valving plate. An ore support plate is positioned at a spaced distance above the entrapment means. Fluid input is provided into the entry chamber and an exhaust orifice is provided in a medial position immediately above the entrapment means and below the ore support plate.

In operation, particulate ore is placed on the upper surface of the ore support plate and pressurized water is introduced into the lower water input chamber. The water moves vertically upwardly through the valving means and entrapment structure to the support plate to there move particulate ore over the periphery of that plate, across the entrapment means and to the exhaust orifice while removing heavier, more dense particles during such activity. The heavier ore particles are captured in the entrapment structure, the valving means are the water input chamber therebelow.

In creating such a device, it is:

A principal object of my invention to provide ore beneficiating apparatus that moves particulate ore material both vertically and horizontally in a fluidic medium to cause heavier ore particles to move downwardly by reason of gravity to an entrapment means from whence they may be recovered.

A further object of my invention to provide such a device that has a vertical container divided into a lower fluid input chamber and an upper processing chamber by a disk-like valving plate having a plurality of areally spaced orifices with gravity biased valving balls to provide evenly distributed fluid flow through the entire valving plate.

A further object of my invention to provide such a device that has ore entrapment structure immediately above the valving plate which not only aids in entrapping more dense ore particles but also allows upward passage of fluid from the valving plate in an areally distributed pattern.

A further object of my invention to provide such a device that feeds ore material over the periphery of the ore support plate and thence inwardly across the entrapment means to a medial exhaust orifice, while at the same time moving that material vertically by means of vertical water flow to establish both the action of a sluice and a jig type fluid bed concentrator.

A further object of my invention to provide such a device that requires a relatively low amount of water in proportions to amount of ore processed and allows that water to be recirculated, if required.

A further object of my invention to provide such a device that is especially adapted to the concentation of more dense metal fractions from the output of ordinary sluice boxes and to the efficient recovery of finer particles of metals, and especially flour gold.

A still further object of my invention to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
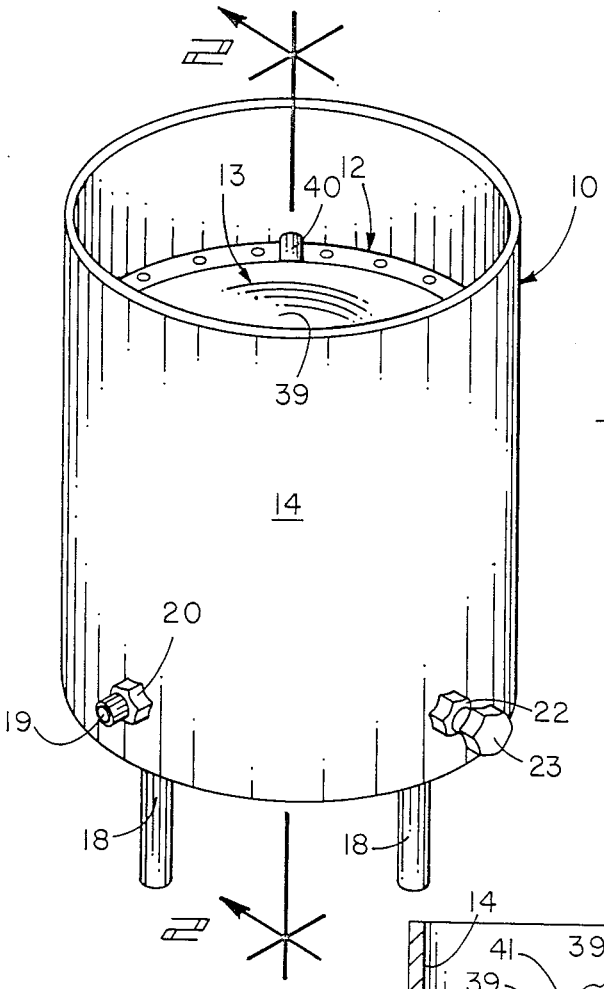
FIG. 1 is an isometric surface view of my invention showing various of its parts, their configuration and relationship.
Figure 2:
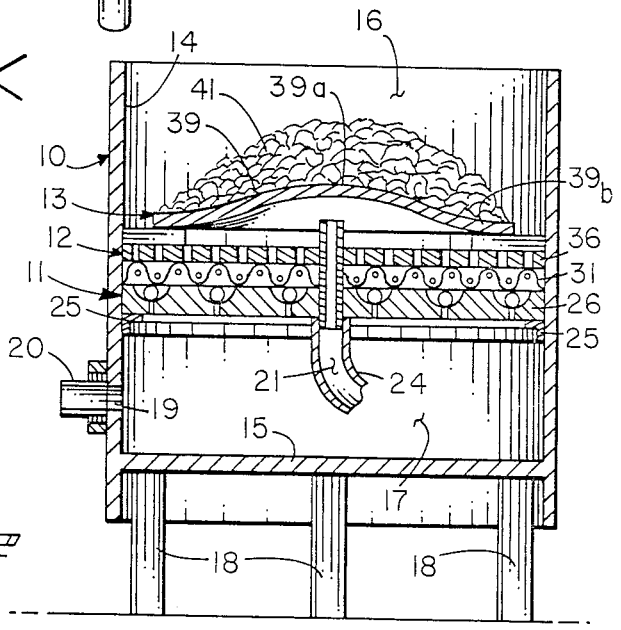
FIG. 2 is a vertical cross-sectional view of the device of FIG. 1, taken on the line 2—2 of that Figure in the direction indicated by the arrows thereon.
Figure 3:
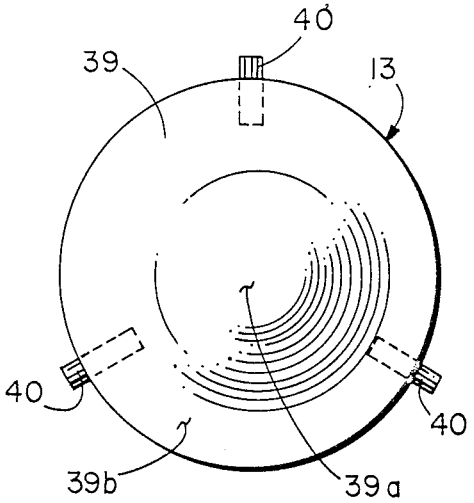
FIG. 3 is an orthographic top or plan view of the ore support plate of my device.
Figure 5:
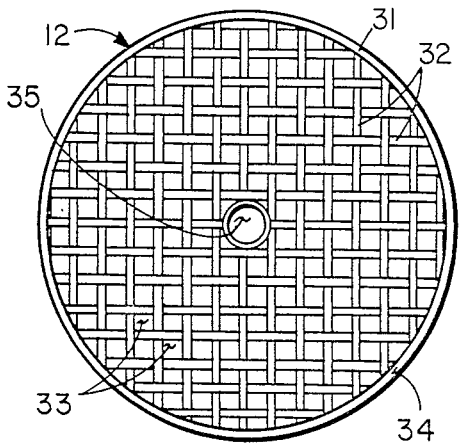
FIG. 5 is an orthographic top or plan view of the screen of the entrapment structure of my device, with the mesh somewhat exaggerated in size for illustration purposes.
Figure 4:
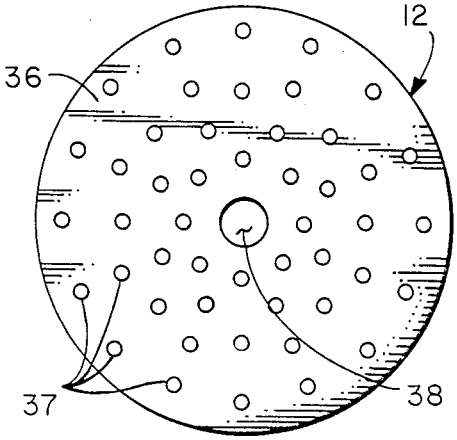
FIG. 4 is an orthographic top or plan view of the hole defining entrapment plate of my device.

My invention generally provides container 10 divided into a lower fluid entrance chamber and an upper processing chamber by medial valving structure 11 which supports entrapment structure 12 immediately thereabove and ore support structure 13 at a space distance above the entrapment structure.

Container 10 in the instance illustrated comprises upstanding peripherally defined cylinder 14 having planar bottom 15, structurally carried at a spaced distance above the bottom of cylinder 14, to define a watertight containment space comprising upper processing chamber 16 and lower fluid input chamber 17. The container is supported at a spaced distance above an underlying supporting surface by plural legs 18, preferably three in number, depending from structural interconnection with bottom 15 to support the container with the bottom substantially horizontal and the side substantially vertical. If desired or necessary, legs 18, or at least some of them (not shown), may be of a compound nature to allow adjustment of the vertical positioning of the container.

Input channel 19 communicates through cylinder 14 in its lower part spacedly above the intercommunication of the cylinder with bottom 15. This input channel 19 is preferably provided with fixture 20 to aid releasable interconnection of some source of pressurized water (not shown) thereto.

Exhaust channel 21 communicates through cylindrical element 14 at approximately the same vertical height but circumferentially spaced from the input channel 19. The exhaust channel is defined in exhaust conduit 24 which is preferably provided with external fixture 22 to aid interconnection with an external exhaust channel (not shown) and is also provided with cap element 23 to allow closure when desired. Exhaust conduit 24 extends from the exhaust port to the entrapment structures as hereinafter more fully described.

The medial portion of the inner surface of cylindrical element 14 structurally carries annular support ring 25 extending inwardly from the inner surface of cylindrical element 14 to releasably support the valving plate immediately thereabove.

This container structure is preferably formed of metal and if so, its various elements are joined by welding. The only requirement of this structure in my invention, however, is appropriate rigidity, strength and durability to serve its purpose, and it is possible the structure could be formed of plastic or other materials having appropriate physical characteristics. The absolute size and configuration of the container structure is not critical to my invention, though both size and configuration must be interrelated to the other elements of the apparatus to allow proper operation of the entire assemblage.

Figure 6:
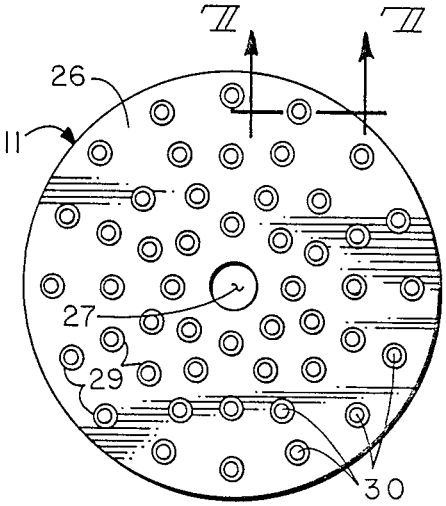
FIG. 6 is an orthographic top or plan view of the valving plate structure of my invention.
Figure 7:
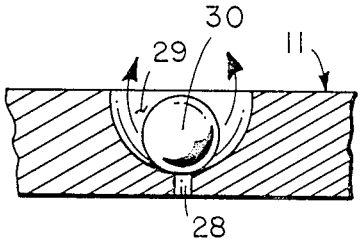
FIG. 7 is a somewhat enlarged partial cross-sectional view through one of the valves of the valving plate illustrated in FIG. 6, taken on the line 7—7 of that Figure in the direction indicated by the arrows thereon.

Valving structure 12 provides flat valve disk 26 of some thickness to allow definition of valving structures and a diameter to fit immediately inwardly adjacent the inner walls of cylinder 14. This fit should be such as to allow the plate to be removed manually from its position on the annular valve support ring 25, but yet should not leave any excess space wherein particulate matter to be processed by the device might accumulate to any extent. The valving disk defines medial, axially aligned exhaust hole 27 of a diameter appropriate to receive exhaust conduit 24 in a good fit. The rigid exhaust conduit extends upwardly through this hole and through the entrapment structure to aid in maintaining alignment of these elements. The valve disk defines a plurality of orifices 28 each communicating from the disk's lower surface upwardly to hemispherical valving holes 29 defined downwardly from the upper surface of the disk. Each valving hole carries spherical ball 30 that acts as a gravity biased valve therein. Orifices 28 may be variously spacedly arrayed in the valving disk, but preferably they are arrayed somewhat as illustrated in FIG. 6 with some radial alignment and closer spacing in the medial portion of the disk then about its periphery. The particular orifices in any disk may be varied in size and array to provide appropriate parameters for the maximum beneficiation of a particular material being processed.

Preferably the valve disk is formed of metal, commonly a mild steel, but other materials having appropriate rigidity, strength and durability might be substituted. Valving balls 30 normally will be formed with a diameter about half that of valving holes 29, as illustrated, but obviously with a diameter at least greater than that of the associated valve orifices, from some heavy material, such as steel or preferably lead. The density and weight of the valving balls will effect their valving action and constitute a parameter which may be varied to suit particular processing needs.

Entrapment structure 12, in the instance illustrated, includes screen disk 31 and hole disk 36. The screen disk is formed of woven wire mesh 32 defining orifices 33. It commonly has an annular peripheral element 34 to reinforce the structure at this point and another annular element to define medial exit channel orifice 35 axially aligned therein. The screen element may provide varying mesh and orifice sizes to vary parameters of the systems and again allow adaptation to particular ore beneficiation needs. The mesh size should be small enough that it will aid in maintaining valving balls 30 in valving holes 29 and not allow those valving balls to pass upwardly out of their containing holes by reason of water pressure exerted thereon from below.

Hole disk 36 is a flat circular disk defining a plurality of spacedly arrayed holes 37 and a medial axially aligned orifice 38 to receive exhaust conduit 24. The size and array of holes 37 is not particularly critical, but again provides a parameter which may be varied to meet particular conditions of use. Commonly for best results, the holes are radially arrayed and more dense near the axis of the disk then near its periphery. Again preferably, the array of holes in the hole plate, or at least a part of them will be the same as the array of orifices in the valve plate so that the two sets of holes will coincide, to provide a more uniform and homogeneous flow of water through both the valving and entrapment structures.

Preferably both disks of the entrapment structure are formed of metal to privde appropriate durability and rigidity. Other materials having similar physical properties may be substituted, and in some cases certain modern plastics and resinous materials may be equal or superior to their metal counterparts. The external diameter of both elements of the entrapment structure should be such as to fit immediately inwardly adjacent the walls of cylinder 14 so that the elements may be manually removed, but yet do not leave any substantial space between the adjacent surfaces of these elements.

Ore support structure 13 provides ore support disk 39 structurally carrying depending support elements 40 to position and support the disk at a spaced distance above hole defining disk 36. The support disk is of the same peripheral shape as cylindrical element 14, but somewhat smaller so that the periphery of the support disk may be positioned at a spaced distance from the inner surface of the cylindrical element. This spaced distance is such as to allow particulate ore material to pass downwardly over the periphery of the ore support disk and into the processing structure of my invention therebeneath. Normally the space in a radial direction should be approximately 0.5 inch, though this dimension provides an additional parameter which may be varied to adapt my invention to efficient use with a particular ore.

Support elements 40 are preferably three in number and depend symmetrically from the under surface of the ore support disk. These supports have some length in a radial direction and preferably extend beyond the periphery of the support disk to define a circle substantially the same size as that of the inner surface of cylindrical element 14 so that the legs may serve a secondary purpose of spacing the ore support disk symmetrically within cylindrical element 14 of the container. The vertical dimension of the suport elements also may effect the functioning of my device and provides another parameter that may be varied for a particular use. Preferably for ordinary use the support elements have a vertical extension of approximately 0.5 inch.

The ore support disk preferably is somewhat hat shaped with a higher medial portion 39*a* and a lower peripheral portion 39*b* to aid motion of ore to and over the periphery. The disk is symmetrical about a medial axis so as to constitute a surface of revolution that tends to pass ore over the periphery substantially equally thereabout.

The ore support disk and its supporting legs are preferably formed of metal for durability. Other rigid materials having appropriate physical characteristics, however, may serve the same purposes, if not so well.

Having thusly described the structure of my invention, its function may be understood.

Apparatus is formed according to the foregoing specification and assembled as described and illustrated. A source of pressurized water is attached to input fixture 20, preferably through an adjustable valve (not shown), and an exhaust channel is attached to exhaust fixture 22 to waste the output through the channel of that fixture. In this condition, particulate ore material 41 is placed in a mass, preferably somewhat symmetrically, on top of ore support disk 39 for support thereon. Water is then supplied to fill the container to a level at least to the top of exhaust conduit 24 and the water supply is continued to maintain this water level and allow a water flow through the device.

As this occurs, water enters lower fluid input chamber 17 through input channel 19 and since there is not outflow from that channel except through valve disk 26, the water moves upwardly through orifices 28 defined in that disk, and in so doing will fill the input chamber and thereafter raise valving balls 30 in their containing valving holes to provide a reasonably uniform upward flow of water over the entire area of the valving disk. This upwardly moving water will continue to move further upwardly through screen disk 31 and hole disk 36 until it reaches the horizontal level of exhaust conduit 24 immediately below the medial portion of the lower surface of ore support disk 39. The raised medial part 39*a* of the support disk allows the horizontal level of the exhaust conduit to be above the level of the periphery of the support so that the water level in the processing chamber may be maintained above the support disk periphery. This water level, its flow, and the raised medial portion of the support disk aid the feed of unprocessed ore over the periphery of the feed disk. The ore feed may be manually aided if necessary, but generally manual manipulation will not be required. Various mechanical devices to aid ore feed may be used with my invention, such as vibrators, and are within its scope. Such devices require external powering, however, and are not desirable in many operating situations and such external power sources may not be generally available in many operating environments.

As ore moves downwardly over the periphery of the ore support disk, it comes into admixture with the fluid of in the processing chamber of the system which, in the area between the ore support disk and the hole plate, is moving horizontally inwardly toward exhaust channel 21. This fluid motion will tend to cause the particulate ore material to move in the same direction as fluid flow. As this occurs, the particulate matter will be substantially suspended in the stream of flowing fluid and at the same time, will be acted upon by the forces of gravity so that the more dense or heavier particles will tend to move vertically downwardly a greater distance and more rapidly than the lighter gangue. As this occurs, those heavier particles will tend to move to the upper surface of hole plate 36 and ultimately pass downwardly through the holes defined in that plate. At the same time, these particles will be acted upon by water flow upwardly through the hole plate which will tend to further separate any lighter particulate gangue materials and move them upwardly out of the holes in that plate. As the heavier particles move downwardly through the holes in the hole plate, they will move into the horizontal area defined by the screen plate and generally there accumulate on the screen plate or on top of the valving plate.

It is to be noted that in general the heavier more dense metal particles will not pass downwardly through the valving plate since the holes in that plate will be substantially covered by their associated ball valves so as not to allow the passage of metal particles downwardly therethrough. The substantial portion of larger particles of the heavier metalliferous material will be concentrated on the screen and on the top of the valving plate as my apparatus operates. In the case of quite small particles, such as flour gold, they may be small enough to pass downwardly through the screen and valving structure and below the valving plate where they will either remain in suspension, precipitate to the bottom of the fluid input chamber or again move upwardly through the valving structure. This finer gold or similar particles then will ultimately tend to accumulate in the lower fluid input chamber 17 and may be removed therefrom when the heavier, larger particulate concentrated material is removed from above the valving plate.

As the apparatus operates and the heavier metalliferous particles concentrate, the lighter gangue materials will tend to be carried inwardly over the hole plate toward exhaust channel 21 and ultimately will exit through that channel from whence they may be wasted.

The dimension and configuration of the various elements of my invention as hereinbefore indicated may vary through sizeable ranges and yet provide an operative device. The particular sizing and distribution of holes in the valving structure, hole plate, and screen disk may vary to suit particular conditions. Similarly the thickness of the hole plate and the distance between the adjacent surfaces of the hole plate and the ore support disk will effect the operation of the device and may be varied to accommodate particular conditions. The water flow to and through the structure and the shape of the support disk may similarly be varied to effect the system operation. All of these parameters may be specifically determined empirically or by use of ordinary engineering methods heretofore known in the ore beneficiation arts.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thus described my invention, what I desire to protect by Letters Patent and what I claim is:

1. Apparatus to beneficiate particulate ores containing more dense metalliferous particles and less dense gangue particles comprising, in combination:

a vertical container divided into a lower fluid input chamber and an upper processing chamber by a medially positioned valving disk defining a plurality of areally spaced, valved orifices permitting only upward flow of water therethrough;

an entrapment structure for more dense particles above the valving disk including at least one disk defining plural spaced substantially vertically oriented orifices;

an ore support structure at a spaced distance above the entrapment structure to support particulate ore and allow passage of that ore downwardly to the processing chamber, and means for introducing pressurized fluid into the lower fluid input chamber and means for exhausting fluid and gangue particles from the entrapment structure.

2. The invention of claim 1 wherein the valving disk comprises a rigid disk releasably supported in a horizontal position in the container and each orifice communicating through the disk has an associated valving hole carrying ball-like valving means, free to move vertically within the valving hole against gravity bias responsive to upward fluid pressure thereon.

3. The invention of claim 1 wherein the entrapment structure comprises a first screen disk positioned immediately above the valving plate and a second plate defining a plurality of spacedly arrayed holes immediately above the screen disk.

4. The invention of claim 1 further characterized by the ore support structure comprising a surface with a higher medial portion and a lower peripheral portion to aid movement of particulate ore over the lower peripheral portion thereof.

5. Apparatus for beneficiation of particulate ore wherein a metalliferous fraction is more dense than the gangue fraction comprising, in combination:

a container defining a chamber having vertical extent;

a valving plate releasably supported in a medial position in the container to divide its chamber into a lower fluid input portion and an upper ore processing portion, said valving plate defining a plurality of spacedly arrayed orifices, each orifice having valving means associated therewith to allow fluid flow only upwardly therethrough;

entrapment structure immediately above the valving plate, said entrapment structure defining orifices extending therethrough to allow passage of fluid and to aid in collecting more dense particulate materials;

ore support structure comprising a plate at a spaced distance above the entrapment structure, said plate supporting particulate ore and allowing passage of that ore to the entrapment structure therebelow;

fluid input means communicating with a lower portion of the chamber to input pressurized fluid therein; and exhaust means communicating from the entrapment structure exteriorly of the container to exhaust fluid and less dense particulate gangue.

6. The invention of claim 5 wherein the valving structure orifices each define a channel communicating through the valving disk to an associated hemispherical valving hole each valving hole carrying a ball-like valve to cover the intersection between the valving hole and associated channels, said valves being movable from a gravity biased closed position by upward flow of pressurized water thereagainst.

7. The invention of claim 5 further characterized by the entrapment structure including at least a screen disk resting upon and immediately above the valving structure and a hole disk immediately above and resting upon the screen disk, said hole disk defining a plurality of spacedly arrayed, vertically oriented holes extending through said hole disk and at least a part of said holes being substantialy vertically aligned with the orifices defined in the valving disk.

8. The invention of claim 5 wherein the plate of the ore support structure comprises a surface of revolution with a medial portion vertically above and continuously sloping downwardly to a lower periphery to aid the dispersement of particulate ore over the periphery thereof.

* * * * *